United States Patent [19]

Boyle

[11] 4,424,766

[45] Jan. 10, 1984

[54] HYDRO/PRESSURIZED FLUIDIZED BED COMBUSTOR

[76] Inventor: Bede A. Boyle, P.O. Box 713K, Newcastle, N.S.W. 2300, Australia

[21] Appl. No.: 461,919

[22] Filed: Jan. 28, 1983

Related U.S. Application Data

[63] Continuation-in-part of Ser. No. 416,166, Sep. 9, 1982, abandoned, which is a continuation of Ser. No. 234,469, Feb. 17, 1981, abandoned.

[51] Int. Cl.[3] ..... F22B 1/02

[52] U.S. Cl. ..... 122/4 D; 110/245

[58] Field of Search ..... 122/4 D; 110/345, 347, 110/245; 165/104.16; 432/58

[56] References Cited

U.S. PATENT DOCUMENTS

| | | | |
|---|---|---|---|
| 3,397,657 | 8/1968 | Tada | 110/245 |
| 3,902,462 | 9/1975 | Bryers | 122/4 D |
| 4,009,121 | 2/1977 | Tuckenbach | 122/4 D |
| 4,103,646 | 8/1978 | Yerusholmi et al. | 122/4 D |
| 4,159,682 | 7/1979 | Fitch et al. | 110/245 |
| 4,191,115 | 3/1980 | Yang et al. | 122/4 D |
| 4,280,876 | 7/1981 | Green | 110/245 |
| 4,287,838 | 9/1981 | Frosch | 110/255 |
| 4,330,502 | 5/1982 | Engstrom | 110/245 |
| 4,335,662 | 6/1982 | Jones | 110/245 |
| 4,363,292 | 12/1982 | Engstrom | 110/245 |

FOREIGN PATENT DOCUMENTS

| | | | |
|---|---|---|---|
| 471204 | 5/1975 | Australia . | |
| 2041183 | 9/1980 | United Kingdom | 110/245 |

*Primary Examiner*—Henry C. Yuen

*Attorney, Agent, or Firm*—Stevens, Davis, Miller & Mosher

[57] ABSTRACT

A hydro-pressurized fluidized bed combustor having an upstanding shell and only a single entry at its bottom for admission of feedstock. Inside the shell an entry conduit is outwardly flared in the upward direction to furnish a controlled expansion entry feeding into the fluidized bed. An injector pump feeds the feedstock into the single entry.

9 Claims, 7 Drawing Figures

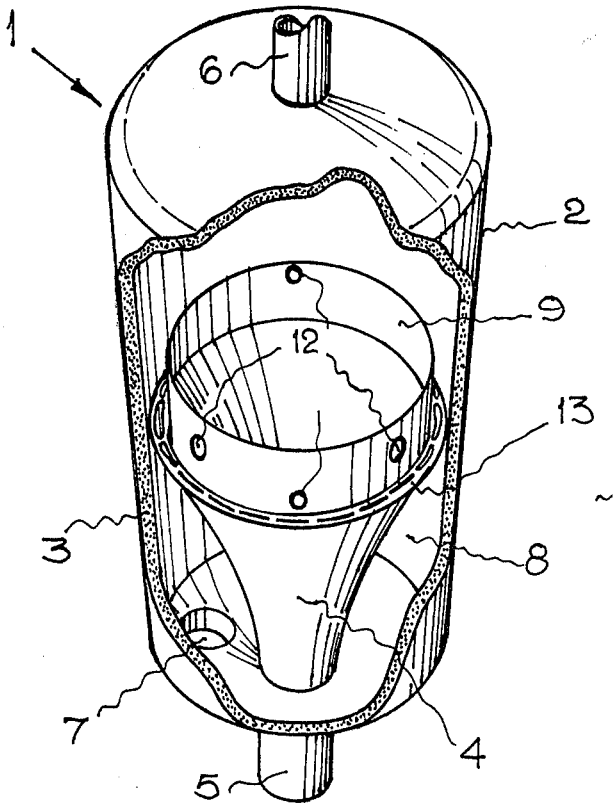
~FIG. 1~
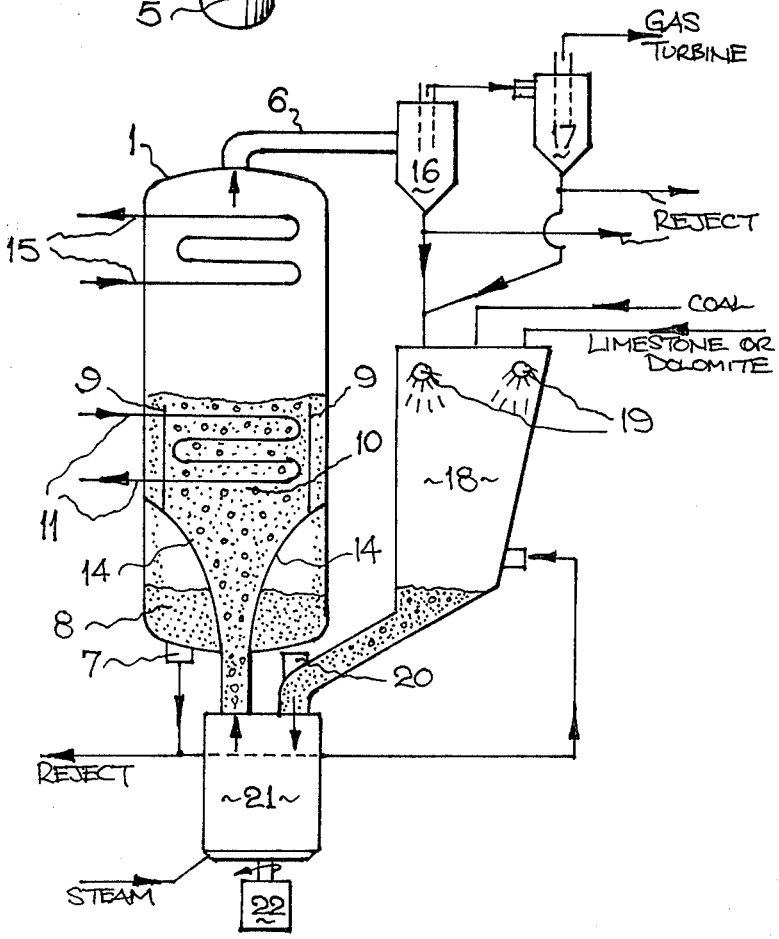
~FIG. 2~

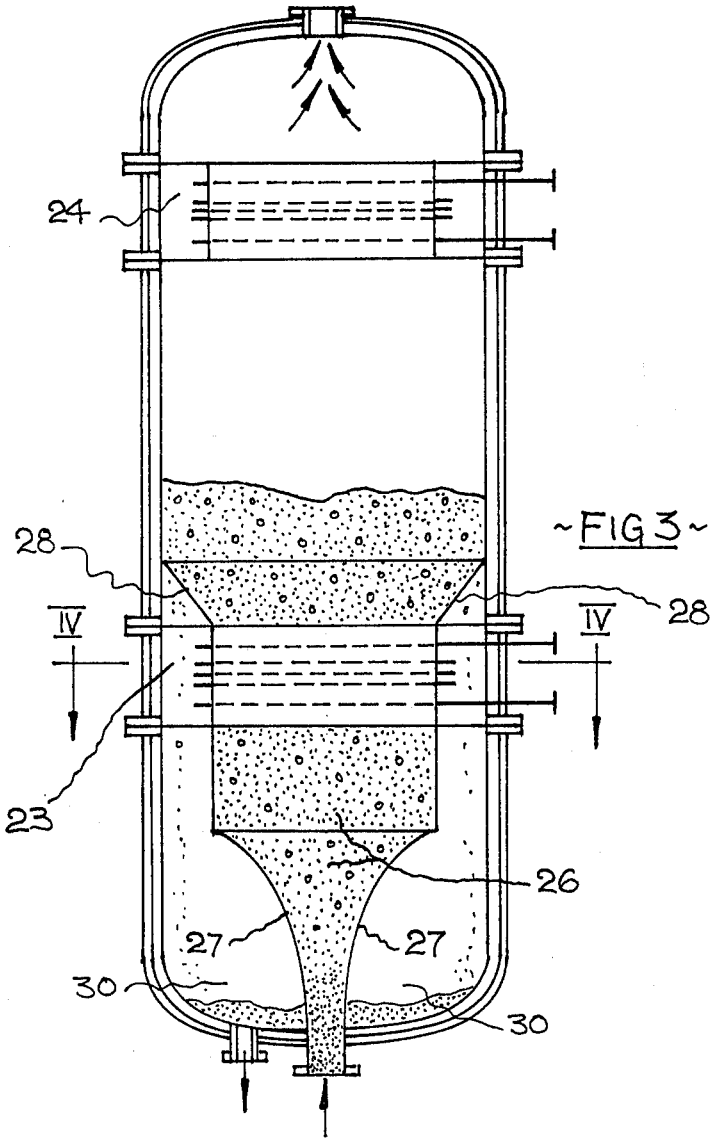
~FIG 3~
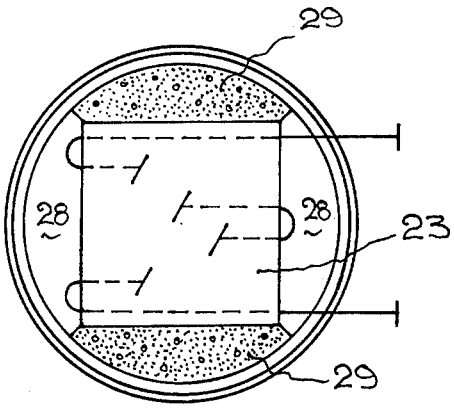
~FIG4~

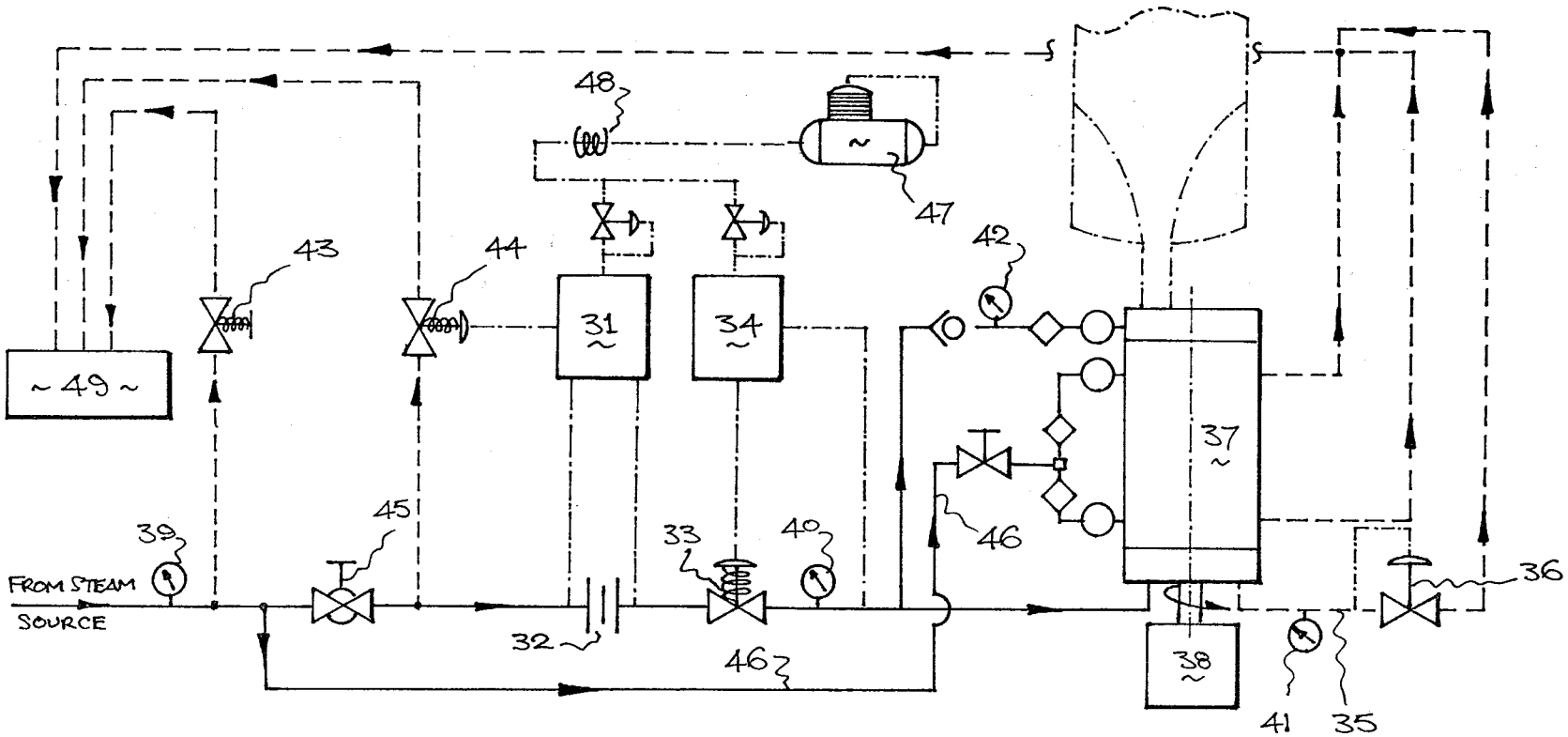
~ FIG. 5 ~

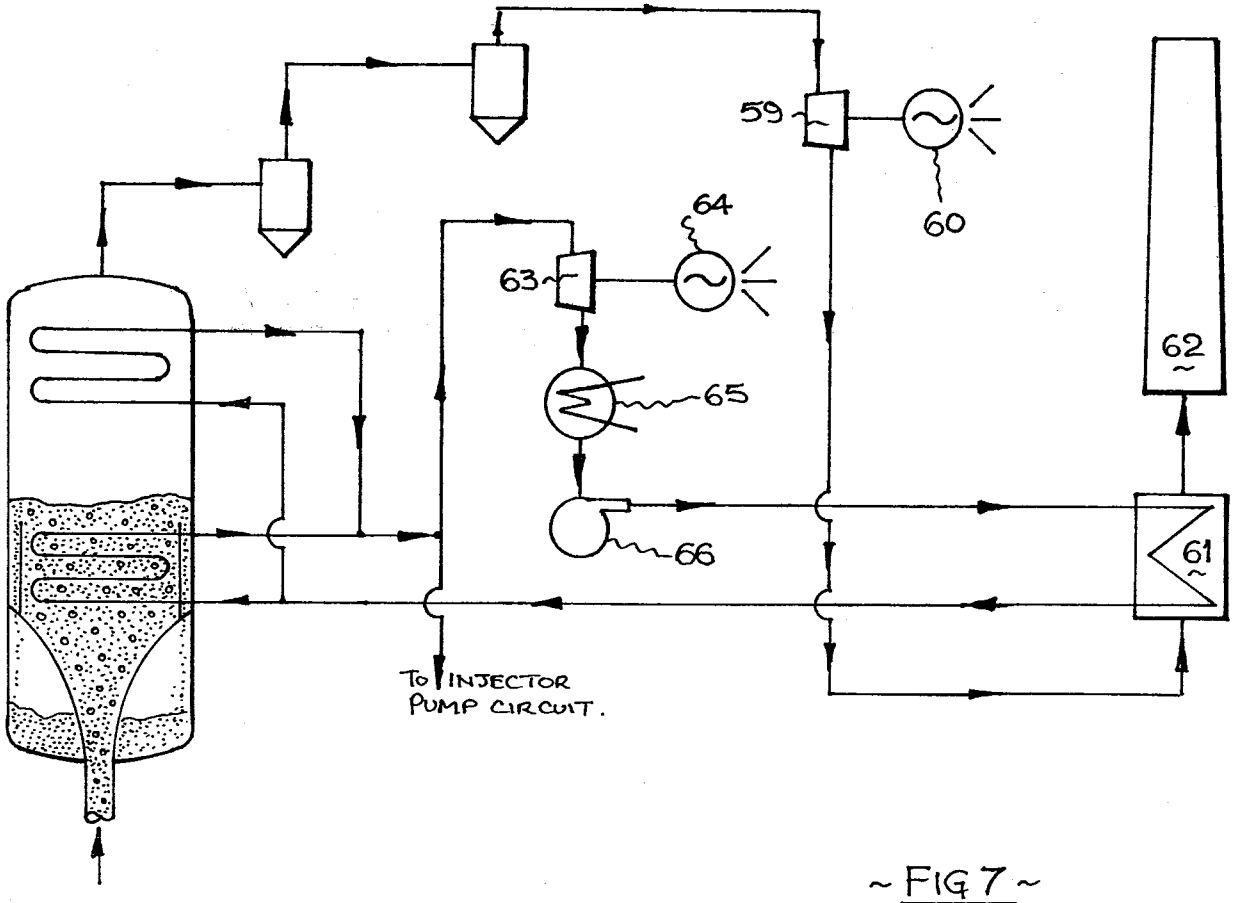
~ FIG 7 ~

HYDRO/PRESSURIZED FLUIDIZED BED COMBUSTOR

This application is a continuation-in-part of application Ser. No. 6/416,166 filed Sept. 9, 1982, now abandoned, which is in turn a continuation of application Ser. No. 234,469 filed Feb. 17, 1981 and now abandoned.

This invention relates to hydro/pressurized fluidized bed combustors, and more particularly to an improved fluidized bed combustor which optimizes the known advantages of current designs and furthers the concept for increasing total overall efficiency when associated with power generation and the like.

The state of the fluidized bed art is set out in U.S. Pat. Nos. 3,902,462 (Bryer); 4,103,646 (Yerushalmi et al); 4,159,682 (Fitch et al); 4,191,115 (Yang et al); 4,259,911 (Jones); 4,280,876 (Green); 4,287,838 (Frosch) and in such publications as the reports of the coal research section of the NCB (IEA Services) Ltd. of the United Kingdom.

Briefly, in fluidized bed combustion, the fuel, which can be coal, gas or oil, is typically burned in a bed of inert particles at between 800° C. and 900° C. through which air is passed. The velocity of the air is sufficient to support the weight of the particles, so that the bed bubbles like a boiling liquid. Combustion in such a system is efficient, and has several advantages over conventional techniques, including:

(a) Reduced boiler costs and more compact combustion systems because of high heat transfer rates to steam generating tubes immersed in the bed.

(b) High tolerance of coal type and mineral matter content.

(c) Because of relatively low operating temperatures fluidized bed combustors can be made of less exotic steels.

(d) If the combustor is operated under pressure around 10–20 atmospheres, it is possible for the flue gases can be exhausted through a gas turbine. A combined cycle of this sort has a higher overall efficiency than the conventional Rankine Steam cycle.

(e) Atmospheric pollution can be reduced by adding limestone or dolomite to the bed to prevent the emission of sulfur dioxide.

Much of the research and development of fluidized combustion has been carried out in the United Kingdom. Preliminary tests were carried out simultaneously at the Central Electricity Generating Board (CEGB), Marchwood Laboratories and the British Coal Utilisation Research Association Laboratories. The CEGB development was subsequently taken over by the National Coal Board at its Coal Research Establishment.

It is an object of the present invention to optimize the design of pressurized fluid bed combustors (PFBC) for applications in the power generation field, thus making redundant high energy conversions for working the existing technology.

All fluidized beds hitherto required large volumes of air at high velocities and pressure to establish the fluid bed concept, and another of the objects of this invention is to dispense with the necessity for this medium. This last-mentioned object is achieved by replacing all the usual air compressors, drives, turbines, reduction gears, pressure vessels, valves and interconnecting piping by one single unit of simplified design and novel concept and application for both starting up and operating the PFBC with simplified automatic control.

For coal combustion, intimate mixing of air and coal must take place. There must be a compromise between providing excessive quantities of air and coal surface available for combustion.

As the supply of large quantities of air at pressures above atmospheric is both capital and energy intensive it is proposed to use only sufficient air to provide complete combustion compatible with the particle size of the feedstock.

According to the invention, in one of its embodiments, the fluidizing of the bed is by use of hydro-fluid instead of the air previously used as the fluid medium in known beds, whether atmospheric or pressurized.

The feedstock is fed into the vessel by a single entry injector and comprises a predetermined mixture of coal, limestone or dolomite, water and air. The state of equilibrium existing between the supporting force of the gas flow and gravitational force of the individual particles is maintained by the high momentum steam (gas bubbles) passing through the hot bed of particulate material. The particles remain in contact with the other surrounding particles with pronounced impulse exchange, leading to continuous change in location of the particles. This results in a fluidized bed having properties which correspond to the behaviour of liquids.

The carbon concentration is usually less than 1% so that a minimum amount of air is required for complete combustion. The formation of large gas bubbles is prevented by the arrangement of the heating surface immersed in the fluidized bed; that is, the fluidized bed is stabilized by them and rendered uniform over the cross section of the heating space.

The fluidizing air is now no longer required in the proposed bed because combustion air is provided in the feedstock, and fluidizing is by means of steam bubbles. It is further proposed that the temperature of the bed can be controlled by the amount of true fluid supplied in the feedstock, allowing for high carbon input with combustion air to be maintained when the bed is under full load conditions. This optimizes the design for applications in the generation of electricity, or marine craft of high power outputs such as bulk carriers and naval vessels.

The resulting hot air, combustion products and steam are mixed and fed to a gas turbine with in-bed tubes either for air heating or steam generation to be used as the working medium for turbine drives. This permits any combination of combined cycles to be used to suit the design application with corresponding high overall efficiencies.

Fuels with high ash content, for example high-ballast bituminous coal, brown coal, pitch sand, oil shale as well as fuels with low reactivity and very high inert component content can be utilized in fluidized bed firing. Changing fuel conditions require no structural change in the firing system or steam generator. With the same firing and feed system it is therefore possible to burn bituminous coal, brown coal or even oil shale.

Depending upon ash composition, it is possible to achieve corresponding desulfurization of the flue gases in the fluidized bed. In addition it is possible by means of additives such as limestone or dolomite to retain the sulfur present in the fuel almost completely in the fluidized bed ash, so that the flue gases emerging to atmosphere meet the requirements of environmental protection agencies with regard to $SO_2$ emission, without any special treatment.

In addition the $NO_x$ emission is considerably reduced as a result of the lower combustion temperature.

During operation, a constant height of bed within the combustor is desirable. This is achieved, depending upon the ash content of the fuel, by feedback of the filter or cyclone ash or by extraction of the ash from the fluidized bed. The height of the bed in a combustor is a function of the cavity proportion of the material and particle size distribution and the velocity of the fluidizing medium, and is ideally fixed so that there is no carry-over of carbon particles which would need recycling for economic operation.

The particulate material of the bed is heated by propane gas burners or similar devices for both warm-up and initial ignition of the fuel. When operating temperature has been reached, the novel feedstock injector takes over and the bed is then on normal operation and the propane burners are shut down.

The applicant's injector pump (which is the subject of U.S. Pat. No. 3,999,895) is capable of handling any combination of the feedstock, either as a single product or in any percentage combination required for control and operation of the bed. It is also capable of delivering the product at a variable delivery rate from zero to full predetermined capacity so that the bed is under automatic control by this single unit, thus reducing the control costs and complexity as compared with existing PFBC units.

According to the invention, in another of its embodiments, the entry port or aperture is preferably shaped such that the particular material of the bed and carbon injector is under controlled expansion by the generated shape of the entry side walls, thus optimizing the distribution of the carbon and controlling the combustion time of rcomplete burn-up with no carry-over.

The achieving of higher efficiencies is dependent upon efficient control, which involves the preparation of fuel and air, the combustion process, and the efficient transfer of heat to steam.

Modern plants working on the Rankine cycle, or modifications of it, have efficiencies of over 30%; the efficiencies of super-critical plants is of the order of 40%. To increase the efficiency beyond this, consideration must be given to gas turbine or mixed steam turbine and gas turbine cycles.

The embodiments of the present invention collectively or singularly increase the efficiency of PFBC beds, and it will be clear to those skilled in this art that a bed designed and operated according to this invention approaches the maximum possible efficiency, for the conservation and utilization of fossil fuel.

Examples of the field of application of the present invention include pyrolysis in cracking carbanaceous solids, the gasification of carbon, and other uses which will be apparent from consideration of the foregoing description.

In order that the reader may gain a better understanding of the present invention, hereinafter will be described certain embodiments thereof, by way of example only, and with reference to the accompanying drawings in which:

FIG. 1 is a partly cut-away perspective view of a hydro/pressurized fluidized bed combustor;

FIG. 2 shows schematically such a combustor and feedstock hopper;

FIG. 3 is a sectional elevation of a modular form of combustor;

FIG. 4 is a cross-section on line IV—IV of FIG. 3;

FIG. 5 is a flow sheet of the control and operating circuit for the injector pump;

FIG. 7 is a flow sheet of one of the possible combined cycles incorporating gas and steam turbines.

Figure 6:
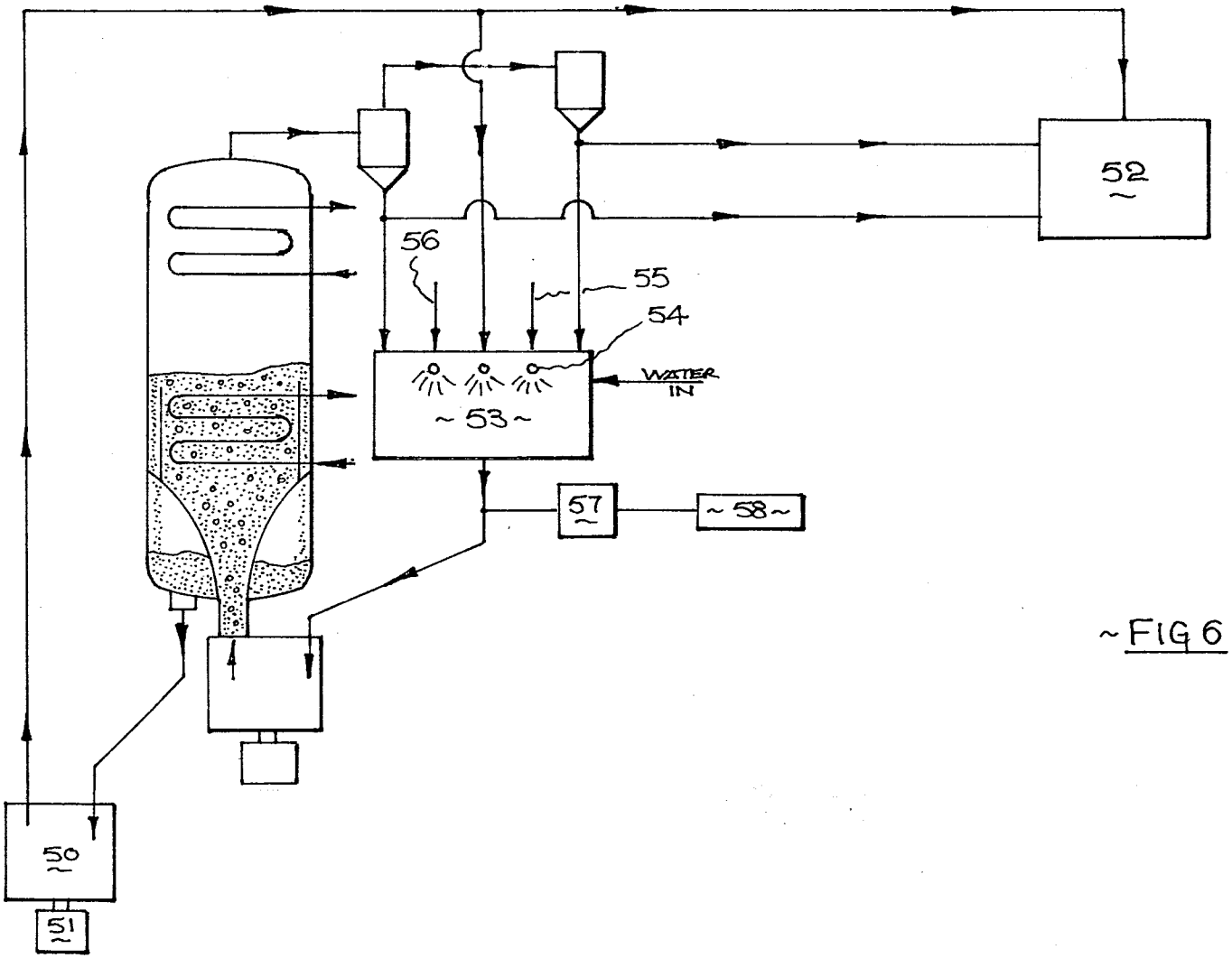
FIG. 6 is a flow sheet showing an alternative method of preparing feedstock.

FIG. 1 is a partly cut-away perspective view of a hydro/pressurized fluidized bed combustor comprising an upstanding shell, generally referenced 1, composed of a steel outer shell 2 and a refractory inner shell 3 of alumina fire-brick material. Accomodated within the lower half of upstanding shell 1 is an upstanding, contoured entry conduit 4 having a trumpet-shaped vertical cross-section which thus presents a gradually-enlarging transverse cross-section in the upward direction, the lower portion of conduit 4 being in communication with an entry port 5. At the top of shell 1 is a flue 6 and in the bottom is located an ash discharge port 7 for the removal of ash or spent fuel from ash-storage space 8. Above conduit 4 is an annular weir 9 the purpose of which is to extract ash from the fluidized bed at a rate which keeps the height of the bed constant within the combustor during its operation. As will be better seen from Figures 2 on, the upper portion of conduit 4 together with weir 9 contains the fluidized bed 10 (see FIG. 2) in the combustion zone of which is located a bank of in-bed steam generation tubes 11 (FIG. 2) which may enter and leave via various apertures such as 12. Extending about the junction of conduit 4 and weir 8 there is an annular grate 13. Conduit 4 and weir 9 are preferably constructed from 20% chromium-iron steel alloy, which metal is suitable for use in temperatures up to about 1100° C., that is to say, well above the designed operating temperature of 800°–900° C.

Turning now to FIG. 2 which shows schematically a hydro/pressurized fluidized bed combustor, shell 1, lined with refractory material as described, may be lagged or clad on the exterior with suitable insulating materials. The contoured walls 14 of the entry conduit control the expansion of the feedstock in its entry to fluidized bed 10, these side walls 14 having a catenoid surface shape which is generated by the rotation of one half of a catenary curve about its x-axis. The major part of the carbonaceous material is combusted in this zone, while above it, heat transfer to the in-bed steam generation tubes 11 takes place, thus restricting the elutriation of carbon material from bed 10.

In the upper half of shell 1 are the freeboard steam generation tubes 15 which, together with in-bed tubes 11, are led to a heat exchanger and thence to a steam turbine circuit. Flue gases leave the combustor via a refractory lined duct 6 (i.e. flue 6 of FIG. 1) and are then passed through high-efficiency cyclones 16, 17 before being discharged to the gas turbine circuit; cyclones 16, 17 are adapted to extract particulate material from the flue gases emitted by the combustor, which material is either rejected or discharged into feedstock hopper 18 for re-cycling.

For the purpose of ash removal the weir 9 is arranged to be at a suitable height, and the ash is discharged to the spent fuel storage space 8 where it is held at an elevated temperature before being re-cycled by re-injection to hopper 18 or rejected via port 7 to a storage and/or disposal area. Feedstock hopper 18 receives predetermined quantities of coal and either limestone or dolomite as indicated, the material being sprayed with water by the sprays 19 to the required fluidity. Combustion air inlet 20 is led to the center of the injector pump 21, with its variable speed drive unit 22, and is automatically controlled by signals measuring the exhaust gas condition.

The temperature of the bed will be controlled by the amount of fluid in the feedstock and if, for any reason, the flue gases rise above an acceptable limit, then a steam spray injector (not shown) is connected either into the top of the combustor or downstream of cyclones 16, 17 in the gas turbine entry duct.

FIGS. 3 and 4 illustrate a combustor of modular construction in which the shell is not a single entity but is composed of five parts. In this embodiment, an in-bed tube module 23 is interchangeable with a freeboard tube module 24 and it will be seen that the entry conduit 26, while having a part of its vertical cross-section trumpet-shaped—27—, is, at least with regards to its upper part, of rectangular transverse cross-section. As will be readily understood, metal tubes located in a combustion zone operational at, say, 700° to 900° C., do not have an extremely long working life - that is, compared with those of a conventional water-tube boiler, so this ability to be removed and replaced is of some considerable economic importance in the operation of a hydro/pressurized fluidized bed combustor apparatus. In such an embodiment as shown in FIGS. 3 and 4, entry conduit 26 has above at weir means 28, two sides of which discharge spent fuel (i.e. ash) 29 to ash-storage space 30.

FIG. 5 is a flow-sheet of the control and operating circuit of the injector pump and, with FIGS. 6 and 7, discloses only matter well-known to those skilled in the art, and is included in this description only in the interests of completion.

Three principal valves provide control of the circuit, 31 being a flow control valve operated by a flow controller and a differential pressure transmitter which operates in conjunction with an orifice plate 32 in the main flow line.

A pressure control valve 33 is operated by the pressure controller 34, while in the flow return line 35 is a back pressure control valve 36. As will be realized, the combustor itself is shown in chain-line while 37 and 38 indicate the injector pump and variable speed drive respectively. Other quite conventional components shown in this flow-sheet are pressure gauges 39, 40, 41 and 42; relief-line valve 43; bypass-line valve 44; flow-line valve 45; lubrication conduit 46; air-compressor 47; air dryer 48; and the drain tank 49.

FIG. 6 is a flow-sheet showing an alternative method of preparing feedstock utilizing a second injector pump 50 and variable speed drive 51 which either discharges ash to spent fuel storage 52 or recycles it to a drum mixer 53 (instead of the feedstock hopper 18 of FIG. 2). Drum mixer 53 also receives extracted particulate material from the cyclones, together with water via spray-heads 54, dolomite through conduit 55 and coal through conduit 56. Ingoing air is controlled by the air inlet control 57 and associated silencer 58.

FIG. 7 is a flow-sheet of one of the possible combined cycles incorporating both gas and steam turbines for increased overall efficiency. Flue gases leave the combustor via the refractory lined duct and pass through the cyclones before reaching the gas turbine 59 and associated generator 60. The flue gases then pass through a heat exchanger 61 before being exhausted up the stack 62. Steam from the in-bed steam generation tube bank in the combustor passes to a steam turbine 63 and associated generator 64, and thence through condenser 65 before circulating pump 66 circulates the gases through heat exchanger 61 and back to the in-bed steam generation tubes.

Clearly, the invention lends itself to a number of different applications, for example:

Coal Conversion

Coal conversion is performed by injecting it with hydrogen in a reactor, at temperatures ranging from 550° to 2,000° C. at pressures of 1 to 150 atmospheres.

Coal can be converted to oil or gas because these substances all contain hydrocarbons, and this is done by altering the hydrogen/carbon ratio of the coal, using one of the following processes:

(a) Hydrogen can be added to the coal.

(b) Carbon can be taken from the coal.

(c) Coal can be broken down into individual carbon atoms and rebuilt.

Most of the presently known methods are based on the addition of hydrogen—which is the direct "liquefaction" process.

Typical resultant products are known as:

(d) Solvent Refined Coal (SRC).

(e) Exxon Donor Solvent (EDS) (produced by solvent).

(f) H-Coal produced by adding hydrogen directly.

In the EDS process, coal is liquefied in a reactor at 850° C. and a pressure of 100 to 150 atmospheres. The hydrogen is supplied by both a donor solvent and in a gaseous form. The donor solvent is a coal liquid derived from the process, which is upgraded in hydrogen content in a separate catalytic reactor. The yield is 2.5 barrels of oil per ton of coal. The H-coal process adds hydrogen to a coal slurry. A catalyst is used to speed the chemical reaction of the gaseous hydrogen with coal in the liquefaction vessel operating at 650° C.

Shale Oil Extraction

Oil shale is actually rock containing an organic material called kerogen. When heated at 900° C. the kerogen vaporizes and is liberated from the rock, and recombines into liquids and some gas.

One problem with shale oil production is what to do with the spent shale, which increases in size by about 20% after it goes through the retorting process. Thus, an operation producing 100,000 barrels a day of oil would have to dispose of 200,000 tonnes of shale rock daily!.

As part of most coal conversion processes, for example, coal must be pumped into the pressurized and heated reactors. Special pumps are needed to do this injecting.

After this mixture passes through the reactor, some of it is recycled. Again pumps are required. The present invention, used in conjunction with the pump which is the subject of the applicant's U.S. Pat. No. 3,999,895, and also with the slurry transporter which is the subject of the applicant's U.S. Pat. application Ser. No. 224,944, now abandoned, is particularly suitable for coal and shale conversions. The pump is also suitable for all three gasification processes, namely, fixed bed, fluidized bed, and entrained bed gasification. The pump can maintain pressure in the feed system while coal or shale is fed steadily into the reactors to form a "seal" against gas back pressure. This eliminates the necessity to bleed off the gases in the feed system with resulting loss of energy, which is typical of the current lock-hopper feed system.

All the moisture in the fuel must be heated from atmospheric temperature (or from the temperature of the fuel if this is above that of the atmosphere) to the temperature at which steam is formed, depending on the working pressure of the combustor. The steam so formed must be heated to the temperature of the furnace gases.

Perfect regulation is seldom attained in practice, and in order to ensure that at least sufficient air is everywhere present to ensure complete combustion, it is desirable to provide an average excess over the quantity theoretically necessary.

The excess mixes with and dilutes the products of combustion, lowering their average temperature and thus reducing the rate at which they will transmit heat. It is thus advisable to reduce the quantity of excess air to the lowest amount which will enable combustion to be just completed.

To summarize the foregoing, the operating temperature-range for a hydro/pressurized fluidized bed combustor is between 700° and 900° C. Control of temperature is by an immersed cooling coil and by varying the amount of moisture in the feedstock.

At any one time only about 1% of all material in the bed is fuel, and all the fuel particles are of less than ¼ inch (6 mm) diameter. As the fuel particles burn they are constantly bouncing among the 99% of inert particles, which carry away the heat produced. For this reason combustion can be stabilized at temperatures well below the melting point of the ash constituents in the fuel. When a tube bundle is immersed in the combustion bed, the effect is of all the particles of the bed whirling around the tubes, resulting in a very high heat transfer coefficient from bed to tubes. That there is only one in every two hundred particles actually burning explains why there is practically no risk of agglomeration, or formation of slag or clinker. The entry velocity of the feedstock (including combustion air) is only 1–2 linear feet/second, while that of the prior art is required to be much higher, the apparatus of Green (U.S. Pat. No. 4,280,876), for example, requiring an entry velocity of about 80 feet per second. At the low velocities of the present invention there is no erosion of the cooling tubes, and only a very small amount of the finest ash particles is likely to be carried off from the top of the bed. These particles have not been exposed to high temperature and are therefore not sintered; they are not hard or abrasive and can be separated by cyclone. Ash is drawn off at bed level over the lip or rim of weir means, and is discharged from the storage zone at the bottom of the shell.

The basic features of the hydro/pressurized fluidized bed combustor of the present invention show clearly why there is no limitation on the amount of ash that the fuel can contain, and neither is there any caking. The bed material can be made up of granulated limestone or dolomite, which is able to capture 90 to 95% of the sulfur in the fuel. The reacted limestone or dolomite can either be disposed of or regenerated as economics may dictate.

The comparatively low prevailing combustion temperature allows the fluidized bed combustor, integrated with a gas turbine, to convert the hot exhaust from the combustor to useful work by expansion through the turbine. In some cases, when working with a gas turbine cycle, there will be no need to employ the freeboard steam generation tube system, as all the cooling tubes can be constituted by those immersed in the fluidized bed.

These new proposals for development of the fluidized bed cycle are radically different from the previous state of the art, since the feedstock consists of screened, crushed coal of up to ¼ inch (6 mm) diameter together with water (and a quantity of limestone or dolomite in some embodiments), which increases the bulk volume of combustion gases to be expanded through the turbine, resulting in increased efficiency.

Other systems require the coal feed to be dried and pulverized for injection into the combustor by means of lock hopper-type feeders worked with an inert gas. These systems increase the carry-over of particles into the exhaust system and have the big disadvantage that the coal feed quickly clogs if it becomes even slightly damp.

What I claim is:

1. A hydro/pressurized fluidized bed combustor comprising:

an upstanding shell having, at the bottom thereof, an entry port for the low velocity entry of feedstock to said combustor, said feedstock including particulate solid material, air and water;

an injector pump connected to said entry port for admission of said feedstock;

an upstanding, contoured entry conduit, having a trumpet-shaped catenoid vertical cross-section gradually enlarging in the upward direction, said conduit being accomodated within the lower half of said upstanding shell and being in communication with said entry port;

a fluidized bed in the upper portion of said entry conduit, for combustion of said feedstock;

at least one in-bed steam generation tube located within said combustion zone;

at least one freeboard steam generation tube located above said combustion zone; and a weir located above said entry conduit and in communication therewith, said weir acting to extract ash from said fluidized bed at a rate which keeps the height of said bed constant within said combustor during operation thereof.

2. The combustor as claimed in claim 1, wherein there is provided an annular grate extending about the junction of said entry conduit and said weir.

3. The combustor as claimed in claim 1, wherein said at least one in-bed steam generation tube and said at least one freeboard steam generation tube are each constructed so as to be in the form of a module, said two modules being interchangeable.

4. The combustor as claimed in claim 1, wherein said injector pump admits said feedstock at a variable delivery rate.

5. The combustor as claimed in claim 1, wherein said feedstock includes coal and limestone.

6. The combustor as claimed in claim 1, wherein said feedstock includes coal and dolomite.

7. The combustor as claimed in claim 1, also including a gas turbine and at least one cyclone adapted to extract particles from flue gases emitted by said combustor.

8. The combustor as claimed in claim 1, wherein said weir discharges ash to storage and/or disposal areas.

9. The combustor as claimed in claim 1, wherein said weir causes the re-cycling of ash to a feedstock hopper which, in turn, feeds said injector pump.

* * * * *